United States Patent [19]

Bowen

[11] 4,436,650

[45] Mar. 13, 1984

[54] LOW VOLTAGE CERAMIC VARISTOR

[75] Inventor: Leslie J. Bowen, Waltham, Mass.

[73] Assignee: GTE Laboratories Incorporated, Waltham, Mass.

[21] Appl. No.: 398,038

[22] Filed: Jul. 14, 1982

[51] Int. Cl.[3] ..... H01B 1/06

[52] U.S. Cl. ..... 252/518; 252/519; 252/520; 252/521; 252/512; 338/20; 338/21

[58] Field of Search ..... 252/518, 512, 521; 338/20, 21

[56] References Cited

U.S. PATENT DOCUMENTS

| | | | |
|---|---|---|---|
| 3,538,022 | 11/1970 | Bowman | 252/518 |
| 3,670,216 | 6/1972 | Masuyama et al. | 252/521 |
| 3,962,144 | 6/1976 | Matsuura et al. | 252/520 |
| 4,069,061 | 1/1978 | Nagasawa et al. | 252/518 |
| 4,160,748 | 7/1979 | Yodogawa et al. | 252/518 |

*Primary Examiner*—Josephine Barr

*Attorney, Agent, or Firm*—Ivan L. Ericson

[57] ABSTRACT

The breakdown voltage of a zinc oxide varistor is lowered by increasing the grain size of the zinc oxide using $Al^{+3}$ as a zinc oxide grain growth promoting agent and the varistor's resistance to high energy electrical surges is increased by an grain boundary barrier layer stabilizer such as $Na^+$, $K^+$, $Rb^+$, or $Cs^+$.

6 Claims, 1 Drawing Figure

LOW VOLTAGE CERAMIC VARISTOR

FIELD OF THE INVENTION

This invention relates to ceramic varistor compositions. More particularly, it is concerned with a low voltage zinc oxide varistor composition.

BACKGROUND OF THE INVENTION

A varistor is an electrical component in which the resistance decreases markedly as the voltage applied across the device increases. This characteristic makes the device suitable for applications such as protection against overvoltage surges in electrical circuits. Several types of varistor are available, including:

Zener or avalanche diodes which are effective in clamping transients to low voltages but are costly to fabricate for high surge energy applications.

Metal oxide varistors, based on zinc oxide or other metal oxides and fabricated by ceramic processing techniques. These devices are inexpensive to fabricate but operate best at high voltages and are difficult to adapt for low voltage (3 to 30 V) applications.

Various voltage-dependent resistors have been widely used for stabilization of voltage of electrical circuits or suppression of abnormally high voltage surges induced in electrical circuits. The electrical characteristics of such voltage-dependent resistors are expressed by the relation:

$$I=(V/C)^n$$

where V is the voltage across the resistor, I is the current flowing through the resistor, C is a constant corresponding to the voltage at a given current and exponent n is a numerical value greater than 1. The value of n is calculated by the following equation:

$$n=[\log_{10}(I_2/I_1)]/[\log_{10}(V_2/V_1)]$$

where $V_1$ and $V_2$ are the voltages at given currents $I_1$ and $I_2$, respectively. The desired value of C depends upon the kind of application to which the resistor is to be put. It is ordinarily desirable that the value of n be as large as possible since this exponent determines the extent to which the resistors depart from ohmic characteristics.

OBJECTS OF THE INVENTION

It is an object of the present invention to provide a varistor composition suitable for the protection of low voltage electrical circuits against transient overvoltages.

It is a further object of this invention to provide a varistor composition which will increase the resistance of the grain boundary barrier layers to degradation by high energy electrical surges.

Further and other objects of the present invention will become apparent from the description contained herein.

SUMMARY OF THE INVENTION

A varistor according to the present invention describes a zinc oxide based composition containing various metal oxide additives which both enhance the growth of ZnO grains during processing and improve the ability of the varistor to withstand high energy voltage surges. Using the prescribed combinations of additives, a stable varistor operating in the voltage range from about 5 to about 100 volts can be obtained.

In accordance with one aspect of the present invention, there is provided an improved varistor of a bulk type comprising a sintered body. The sintered body comprises a main component of zinc oxide, an additive for imparting to the sintered body a voltage-dependent property, a zinc oxide grain growth promoting agent and a grain boundary barrier layer stabilizer. The zinc oxide grain growth promoting agent has a cation which has an ionic radius less than the ionic radius of $Zn^{+2}$ and an ionic valence of three. The grain boundary barrier layer stabilizer imparts to the sintered body a stable grain boundary barrier layer. This stabilizer has a cation which has an ionic radius greater than the ionic radius of $Zn^{+2}$ and an ionic valence of one.

Figure 1:
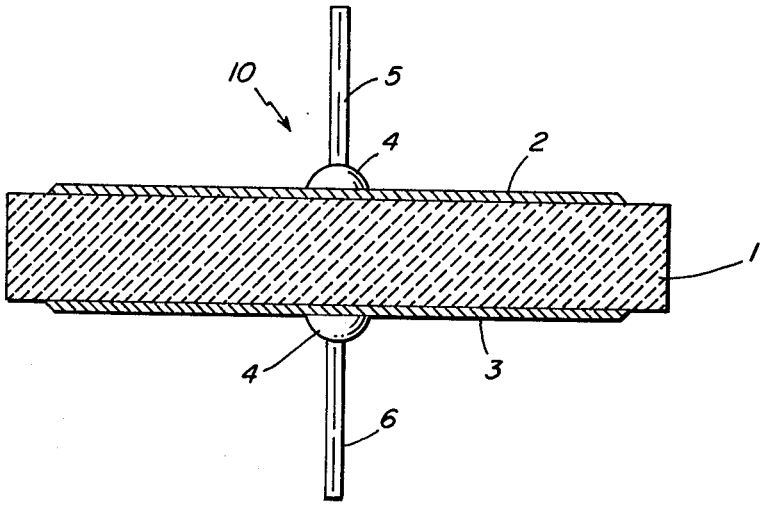
FIG. 1 is a diagrammatic representation of a varistor.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

Illustrated in FIG. 1 is a diagrammatical representation of a varistor 10 comprising, as its active element, a sintered body 1 having a pair of electrodes 2 and 3 in ohmic contact applied to opposite surfaces of the sintered body 1. The sintered body 1 is prepared in a manner hereinafter set forth and is any form such as circular, square or rectangular plate form. Wire leads 5 and 6 are attached conductively to the electrodes 2 and 3, respectively, by a connection means 4 such as solder or the like for connecting the wire leads 5 and 6 to the electrodes 2 and 3, respectively.

The zinc oxide varistor in accordance with the present invention comprises a sintered body of a bulk type. The sintered body comprises from about 77 to about 99 mole percent zinc oxide as the major component of the sintered body. The zinc oxide in the sintered body has an average grain size greater than about 50 microns, preferably greater than about 90 microns. The additives for imparting a voltage-dependent property to the varistor comprise the oxide of elements selected from the group consisting of Bi, Co, Mn, Sb, Cr, Ti, Pb, Ba, Ni, Sn, and combinations thereof, and constitute approximately 3 mole percent of the sintered body composition.

Such a varistor consists of conducting ZnO grains separated by a thin electrically insulating barrier layer. The C value for each barrier layer lies within the range 3 to 3.5 volts. Thus, to reduce the varistor C value it is desirable to increase the size of the zinc oxide grains, thereby reducing the number of barrier layers within the varistor thickness. By increasing the grain size to greater than about 50 microns, it is possible to obtain a low C value while maintaining a manageable varistor thickness (>0.25 mm). However, it is desirable to increase the ZnO average grain size greater than about 90 microns for optimum processability, low clamping voltage and high surge withstanding capability.

The zinc oxide grain growth promoting agent is from about 0.001 to about 1.0 mole percent of the sintered body composition, preferably from about 0.001 to about 0.1 mole percent and most preferably from about 0.001 to about 0.01 mole percent. The grain growth promoting agent has a cation which has an ionic radius less then the ionic radius of $Zn^{+2}$ and an ionic valence of three. The cation of the grain growth promoting agent is $Al^{+3}$ which has an ionic radius of 0.50 angstroms which is less than the ionic radius of $Zn^{+2}$, 0.74 angstroms. The values for the ionic radii are found in the Table of Periodic Properties of the Elements, E. H. Sargent & Co. (1962).

The grain boundary barrier layer stabilizer imparts a stable grain boundary barrier layer and is from about 0.001 to about 10 mole percent of the sintered body composition, preferably from about 0.001 to about 0.1 mole percent. The stabilizer has a cation which has an ionic radius greater than the ionic radius of $Zn^{+2}$ and an ionic valence of one. The cation of the stabilizer is selected from the group consisting of $Na^+$, $K^+$, $Rb^+$, $Cs^+$ and combinations thereof or from any other cation which has an ionic valence of one such as $Ag^+$, $Tl^+$ and having an ionic radius greater then $Zn^{+2}$. The ionic radius of the above cations are listed in table I.

TABLE I

| Cation | Ionic Radius in Angstroms |
|---|---|
| $Na^+$ | 0.95 |
| $K^+$ | 1.33 |
| $Rb^+$ | 1.48 |
| $Cs^+$ | 1.69 |
| $Ag^+$ | 1.26 |
| $Tl^+$ | 1.40 |

Specific examples of the present invention were prepared by the following steps:

The components listed in table II, used to make up compositions A, B, D, E, and F, were mixed thoroughly with distilled water. The resulting slurry was dried without segregation or settling.

TABLE II

| Composition | Components | Weight % |
|---|---|---|
| A | ZnO | 92.30 |
| | $MnO_2$ | 1.40 |
| | $Co_3O_4$ | 0.80 |
| | $Cr_2O_3$ | 0.14 |
| | $Sb_2O_3$ | 0.16 |
| | $Bi_2O_3$ | 4.00 |
| | $TiO_2$ | 0.80 |
| | PbO | 0.40 |
| B | Composition A plus 50 ppm $Al^{3+}$ | |
| D | Composition B plus 60 ppm $Na^+$ | |
| E | Composition B plus 100 ppm $K^+$ | |
| F | Composition B plus 18 ppm $Li^+$ | |

The dried mixture was sieved, calcined at about 700° C. for about ten hours and ball milled in distilled water plus an organic pressing aid for two about hours, taking care to minimize contamination during milling. This slurry was dried without segregation, sieved to less than about 80 μm agglomerate size and pressed into discs at about 15,000 psi pressure. The organic pressing aid was burned out at about 700° C. in air and the discs sintered in a closed crucible at about 1400° C. for one hour in oxygen. The rate of cooling from the sintering temperature was approximately 2.5° C. per minute. Electrodes were applied to the major surfaces of the discs by firing on a commercially available silver paste composition e.g. Dupont 7713. The final diameter of the discs was 9 mm.

Electrical measurements were made on compositions designated A, B, D, E and F in table III. The measurement sequence was as follows: first, measure current as a function of applied voltage to determine $C_I$; second, apply fifty electrical surges at eleven second intervals (pulse duration 10×1000 μs, maximum surge current 40 amps/centimeters squared); third, measure current-/voltage characteristics to obtain Cp. A change ΔC equal to or greater than 10% of the original C value ($C_I$) is commonly employed as a failure criterion for varistors.

In table III, composition A has a mean grain size of 64 μm giving a $C_I$ value of 28 volts/mm and a ΔC value of 3.6%. Composition B has 50 ppm $Al^{3+}$ and has a larger grain size of 104 μm, lower $C_I$ value of 8 volts/mm but a large ΔC of 32.5%. Compositions D and E contain 60 ppm $Na^+$ and 100 ppm $K^+$ respectively and have large grain sizes, low $C_I$ values and low ΔC values. Composition F contains 18 ppm $Li^+$ and also has very low ΔC but the small ionic size of $Li^+$ (0.60 angstroms) enables lithium to substitute for $Zn^{+2}$ in ZnO and thus, counteracts the effect of $Al^{+3}$ on grain growth. Thus, the grain size of composition F is only 62 μm and its $C_I$ value is comparatively high at 23 V/mm.

TABLE III

USE:

$$I = \left(\frac{V}{C}\right)^n$$

V = Applied Voltage

I = Current $$n = \frac{\log_{10}\left(\frac{I_2}{I_1}\right)}{\log_{10}\left(\frac{V_2}{V_1}\right)}$$

C = V when I = 1 mA

| Specimen No. | Average Grain Size (μm) | $C_I$ (volts/mm) | $C_p$ (volts/mm) | $\frac{C_I - C_p}{C_I}$ (%) = ΔC |
|---|---|---|---|---|
| A | 64 | 28 | 27 | 3.6 |
| B | 104 | 8 | 5.4 | 32.5 |
| D | 98 | 9.5 | 8.6 | 9.5 |
| E | 93 | 10 | 9.5 | 5 |
| F | 62 | 23 | 23 | 0 |

A = Basic Varistor Composition
B = Composition A + 50 ppm $Al^{3+}$
D = Composition B + 60 ppm $Na^+$
E = Composition B + 100 ppm $K^+$
F = Composition B + 18 ppm $Li^+$
$C_I$ = Value of C before pulse testing
$C_p$ = Value of C after pulse testing As shown in table II, compositions D and E contain the additives for imparting to the sintered body a voltage-dependent property, a zinc oxide grain growth promoting agent, $Al^{3+}$, and a grain boundary barrier layer stabilizer, $Na^+$ for specimen D and $K^+$ for specimen E.

As shown in table III, the average grain size of the zinc oxide grains in both specimens D and E is greater than 50 microns and both specimens have a $C_I$ value less than 20 volts and have a resistance to pulse degradation.

While there has been shown and described what is at present considered the preferred embodiments of the invention, it will be obvious to those skilled in the art that various changes and modifications may be made therein without departing from the scope of the invention as defined by the appended claims.

What is claimed is:

1. A varistor comprising a sintered body of a bulk type, said sintered body consisting essentially of zinc oxide as a main component of the sintered body, said zinc oxide having an average grain size greater than about 50 microns;

an additive for imparting to the sintered body a voltage-dependent property, said additive comprising the oxide of elements selected from the group consisting of Bi, Co, Mn, Sb, Cr, Ti, Pb, Ba, Ni, Sn, and combinations thereof, and being approximately 3 mole percent of the sintered body composition;

a zinc oxide grain growth promoting agent, said agent having a cation having an ionic radius less than the ionic radius of $Zn^{+2}$ and the cation of said agent having an ionic valence of three, said cation of said zinc oxide grain growth promoting agent being aluminum, said zinc oxide grain growth promoting agent being from about 0.001 to about 1.0 mole percent of said sintered body;

and a grain boundary barrier layer stabilizer for imparting to the sintered body a stable grain boundary barrier layer, said stabilizer having a cation having an ionic radius greater than the ionic radius of $Zn^{+2}$ and the cation of said stabilizer having an ionic valence of one, said cation of said stabilizer being selected from the group consisting of sodium, potassium, rubidium, cesium, and combinations thereof, said stabilizer being from about 0.001 to about 10 mole percent of said sintered body.

2. A varistor according to claim 1 wherein said zinc oxide grain growth promoting agent is from about 0.001 to about 0.01 mole percent of said sintered body.

3. A varistor according to claim 1 wherein said stabilizer is from about 0.001 to about 0.1 mole percent of said sintered body.

4. A varistor according to claim 1 wherein said average grain size is greater than about 90 microns.

5. A varistor according to claim 1 wherein said zinc oxide grain growth promoting agent is from about 0.001 to about 0.01 mole percent of said sintered body and said stabilizer is from about 0.001 to about 0.1 mole percent of said sintered body.

6. A varistor according to claim 5 wherein said cation of said zinc oxide grain growth promoting agent is aluminum and said cation of said stabilizer is selected from the group consisting of sodium, potassium, rubidium, cesium, and combinations thereof.

* * * * *